US009055828B2

(12) United States Patent
Burchell

(10) Patent No.: US 9,055,828 B2
(45) Date of Patent: Jun. 16, 2015

(54) ADJUSTABLE SHELVING UNIT

(71) Applicant: Smart Systems, Inc., Pittsburgh, PA (US)

(72) Inventor: James R. Burchell, North Versailles, PA (US)

(73) Assignee: Smart Systems, Inc., Pittsburgh, PA (US)

( * ) Notice: Subject to any disclaimer, the term of this patent is extended or adjusted under 35 U.S.C. 154(b) by 0 days.

(21) Appl. No.: 14/090,472

(22) Filed: Nov. 26, 2013

(65) Prior Publication Data

US 2014/0144854 A1 May 29, 2014

Related U.S. Application Data

(60) Provisional application No. 61/729,684, filed on Nov. 26, 2012.

(51) Int. Cl.

| | |
|---|---|
| ***A47F 1/00*** | (2006.01) |
| ***A47F 1/12*** | (2006.01) |
| ***A47F 5/00*** | (2006.01) |

(52) U.S. Cl.

CPC ..... *A47F 1/125* (2013.01); *A47F 5/005* (2013.01)

(58) Field of Classification Search

CPC ..... A47F 1/00; A47F 1/12; A47F 1/125; A47F 1/126; A47F 5/005

USPC ..... 211/43, 51, 59.2, 59.3, 88.02, 90.01, 211/90.02, 126.15, 175, 183, 184; 312/35, 312/42, 61, 71; 108/60, 61

See application file for complete search history.

(56) References Cited

U.S. PATENT DOCUMENTS

| | | | | |
|---|---|---|---|---|
| 5,469,976 | A * | 11/1995 | Burchell | 211/59.3 |
| 6,227,386 | B1 * | 5/2001 | Close | 211/59.3 |
| 6,357,606 | B1 | 3/2002 | Henry | |
| 7,168,579 | B2 | 1/2007 | Richter et al. | |
| 7,451,912 | B1 * | 11/2008 | Taube, II | 232/29 |
| 7,458,473 | B1 | 12/2008 | Mason | |
| 2005/0139560 | A1 | 6/2005 | Whiteside et al. | |
| 2007/0095772 | A1 | 5/2007 | Hardy | |

OTHER PUBLICATIONS

Notification of Transmittal of the International Search Report and the Written Opinion of the International Searching Authority, or the Declaration for PCT Application serial No. PCT/US2013/072003, Mar. 13, 2014.

* cited by examiner

*Primary Examiner* — Joshua Rodden
(74) *Attorney, Agent, or Firm* — Beck & Thomas, P.C.

(57) ABSTRACT

Shelving units having an adjustable width. The shelving units here provide structural stability and simple adjustment of width to accommodate varying product sizes. The distance between side walls of the shelving units can be adjustable in two manners. First, the distance is continuously adjustable from within a range established by slots located in a base portion of side wall components. Second, a further range of shelving unit depth may be generated by changing the orientation of the side wall components. The side wall components of the shelving units may be formed in an L shape with one side longer than the other. By rotating the side wall components, a new range of product widths may be accommodated by the shelving unit. The shelving units may also include a simple mechanism that can be used to advance products toward the front of the shelf.

13 Claims, 5 Drawing Sheets

ADJUSTABLE SHELVING UNIT

CROSS-REFERENCE TO RELATED APPLICATIONS

This application claims the benefit under 35 U.S.C. §119 (e) of the earlier filing date of U.S. Provisional Patent Application No. 61/729,684 filed on Nov. 26, 2012.

BACKGROUND OF THE INVENTION

1. Field of the Invention

The present invention relates generally to systems for managing and allocating shelf space among rows of products. More particularly, the present invention is directed to integrated shelf allocation management systems accommodating varying product sizes easily.

2. Description of the Background

In retail stores, such as grocery stores, products are displayed on shelves for customers to inspect and select. To attract customers to a particular product and/or to facilitate a convenient shopping experience, products are preferably organized in an orderly fashion on the store shelves. Moreover, because wasted shelf space wastes money, the products should efficiently use shelf space.

For orderly presentation to customers, products may be divided into rows with dividers between rows so that each product row remains confined to a designated area and does not shift or cross over into another row.

Additionally, vendors prefer to move the products to the front of the shelf so that the customer may easily view the products or reach them for purchase. If the products are hidden at the back of the shelf, the customer may not see or be able to reach them resulting in potential loss of sales.

Some traditional systems employ dividers that are separately attached to either the shelf itself or to locating strips that run lengthwise along the front of the shelf. Due to the separated nature of the dividers, these systems lack the structural stability of an integrated unit in which both side walls are joined by a base piece. As a result, the dividers may fail to provide a rigid enough barrier to confine products to one particular row or may fall down, thus limiting their utility. Further, the permanent or semi-permanent nature of the attachment of the dividers to the shelf makes it difficult to reposition the dividers in these systems to accommodate varying product shapes and sizes. To accomplish such tasks, each divider is manually removed from either the shelf itself or a locating strip, repositioned, and reattached at a new position on the shelf or locating strip. That step can be both time consuming and inconvenient.

There has been a long-standing need in the commercial vendor community for an integrated shelving management system that is able to accommodate products of varying sizes. The present invention addresses this need.

SUMMARY OF THE INVENTION

The present invention addresses the limitations currently existing within the art and provides a cost-effective integrated shelf allocation management system. Such a system preferably provides structural stability and is also quickly and easily adjustable to accommodate varying products shapes and sizes. The present invention may also incorporate a mechanism that provides for the efficient advancing of products toward the front of the shelf for customer inspection and selection.

The integrated shelf allocation management system allocates space along a retail store shelf among rows of product. Through the innovative design, the embodiments of the present invention are able to accommodate products having a wide range of widths. The side walls of the shelving units of the present invention are adjustable in two primary ways. First, the distance between the side walls is continuously adjustable from within a range established by slots located in the base portion of the side wall components, as described below.

Second, the orientation of the side wall components may be adjusted to allow for a larger range of product widths to be accommodated. The side wall components of the shelving units of the present invention may be formed in an L shape with one side of the L being longer than the other. By rotating the side walls, a new range of product widths may be accommodated by the shelving unit.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the invention, while eliminating, for purposes of clarity, other elements that may be well known. The detailed description will be provided herein below with reference to the attached drawings.

The present invention addresses the limitations currently existing within the art and provides a cost-effective integrated shelf allocation management system. Such a system preferably provides structural stability, allowing it to be easily placed on, moved, or removed from the shelf due to its integrated form. The present invention allows a shelving unit with product loaded to be moved from one shelf to another, dramatically reducing the time required for stocking, restocking, and resets of product. The present invention is also quickly and easily adjustable to accommodate varying products shapes and sizes. The present invention may also incorporate a mechanism that provides for the efficient advancing of products toward the front of the shelf for customer inspection and selection.

As used herein, the "front" of the integrated shelf allocation management system refers to the portion resting on that part of the shelf surface closest to the aisle where a customer may easily view and/or select a product. The "rear" of the system refers to the portion resting of that part of the shelf surface farthest away from the aisle. As used herein, the term "integrated" means that the recited components remain engaged as a single unit regardless of the chosen position. As used herein, "longitudinally" means the dimension that extends from the front of the shelf to the rear. As used herein, "orthogonally" means orthogonal to the longitudinal axis.

The integrated shelf allocation management system allocates space along a retail store shelf among rows of product. The integrated shelving unit also provides for the movement of product toward the front of the shelf as described below. Through the innovative design, the embodiments of the present invention are able to accommodate products have a range of widths. The side walls of the shelving units of the present invention are adjustable in two primary ways. First, the distance between the side walls is continuously adjustable from within a range established by slots located in the base portion of the side wall components, as described below.

Second, the orientation of the side wall components may be adjusted to allow for a larger range of product widths to be accommodated. The side wall components of the shelving units of the present invention may be formed in an L shape with one side of the L being longer than the other. By rotating the side walls, a new range of product widths may be accommodated by the shelving unit, as described more fully hereinbelow.

Figure 1:
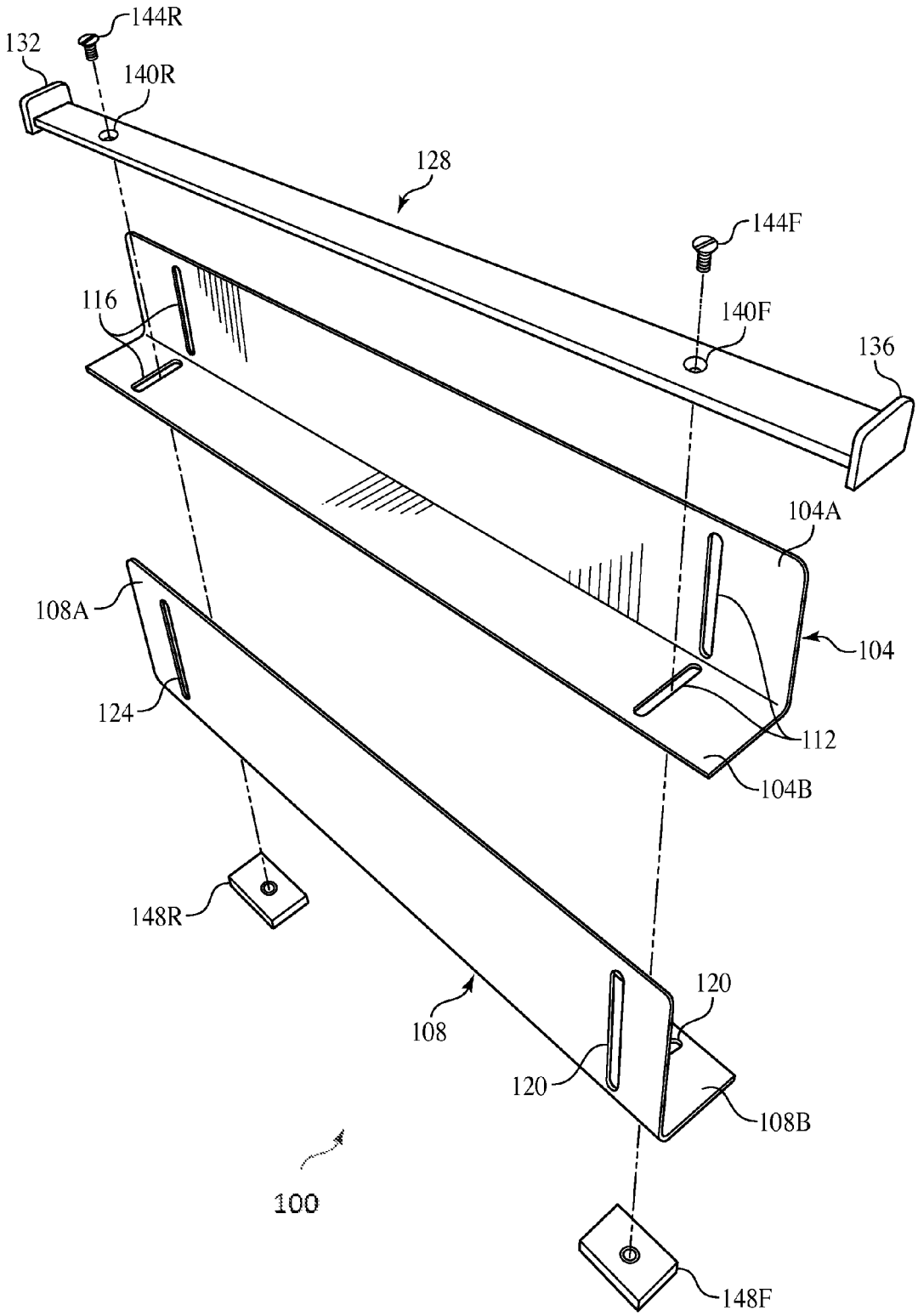
FIG. 1 is a view of an disassembled shelving unit of an embodiment of the present invention.

FIG. 1 shows a disassembled shelving unit of an embodiment 100 of the present invention. The shelving unit 100 of FIG. 1 includes a base which runs along a longitudinal axis, two side wall components 104, 108, and a mechanism for securing the assembly together. The apparatus 100 may also include a central rail 128 that serves to stabilize the entire assembly and provide a surface on which the product may rest and be slid towards the front of the shelving unit 100 as described below.

The side wall components 104, 108 are roughly L-shaped such that a portion of the side component forms the wall of the shelving unit and a portion of the side wall component forms part of the base of the shelving unit. The vertical portion of each side wall component 104A, 108A is located on opposing sides of the shelving unit and extends vertically at approximately a 90-degree angle from the base. Both side wall components 104, 108 preferably have the same dimensions. In accord with the present invention, each L-shaped side wall component includes a long arm 104A, 108A and a short arm 104B, 108B. The arms may have a wide variety of dimensions as dictated by the specific implementation in which the shelving units of the present invention are employed. The side walls of the shelving unit may be defined by the long arm of the right side wall component 104A and the long arm of the left wall component 108A, if the long arm of each component is oriented vertically. If the orientation of the side wall components is changed as described below, the side walls of the shelving unit may instead by defined by the short arm of the right side wall component 104B and the short arm of the left side wall component 108B.

Each side wall component preferably includes slots oriented orthogonally in both the vertical and horizontal portions of the side component. In some embodiments, there are two pairs of slots 112, 116, 120, 124, on each side wall component, 104,108, such as the one shown in FIG. 1. One pair of slots 112 is towards the front of side wall component 104 and includes a slot in the vertical portion of the side wall component and a slot in the horizontal portion of the side wall component 104. The second pair of slots 120 is located at the same distance from the front of the front of the side wall components in the complementary side wall component 108 for the embodiment shown in FIG. 1. The sets of slots 112,120 towards the front of the side wall components 104,108 are located at the same distance from the front of the side wall components, so that the slots in the base of the left side wall component 120 align with the slots in the base of the right side wall component 112, for the embodiment shown in FIG. 1. The sets of slots 116,124 towards the rear of the side wall components 104,108 are similarly located at the same distance from the front of the side wall components 104,108. While the embodiment shown in the attached figures has two pairs of slots, other embodiments are contemplated in which there are more pairs of slots in the slide component, depending on the stability desired by the person implementing the present invention.

The central rail 128 of some embodiments of the present invention is also shown in FIG. 1. The central rail 128 may provide stability to the shelving unit, allowing it to be picked up and moved, even when product is housed on the shelving unit. As shown in FIG. 1, the central rail 128 may include front and rear vertically oriented barrier elements 132, 136 that are effective to stop product housed in the shelving unit 100 from falling from the front or rear of the shelving unit, respectively. For partially this reason, the barrier elements 132, 136 preferably extend above and below the longitudinal aspect of the central rail 128. Additionally, a portion of the front barrier element 136 may be used to click into a guide strip attached to the shelf. This mechanism may thus be used to stabilize the location of the shelving unit 101 on the shelf, avoiding left-right and front-back shifting of the shelving unit. The portion of the front and rear barrier elements 132, 136 that extends below the central rail may also provide support and stability for the shelving unit 100.

For the embodiment shown in FIG. 1, the central rail 128 includes two holes 140R, 140F, though other configurations are contemplated as discussed below. In this embodiment, the holes 140R, 140F are located at the same distance as their respective sets of slots in the side wall components. The holes are located roughly in the middle of the central rail 128 for this embodiment. The number of holes in the central rail may match the number of pairs of slots in the side wall components. The holes 140R, 140F in the embodiment shown in FIG. 1 are adapted to receive a bolt 144R, 144F, as described below, which acts as a mechanism for securing the assembly together. As such, each hole140R, 140F may be beveled to complimentarily accept the head of bolt 144R, 144F, respectively.

Figure 3:
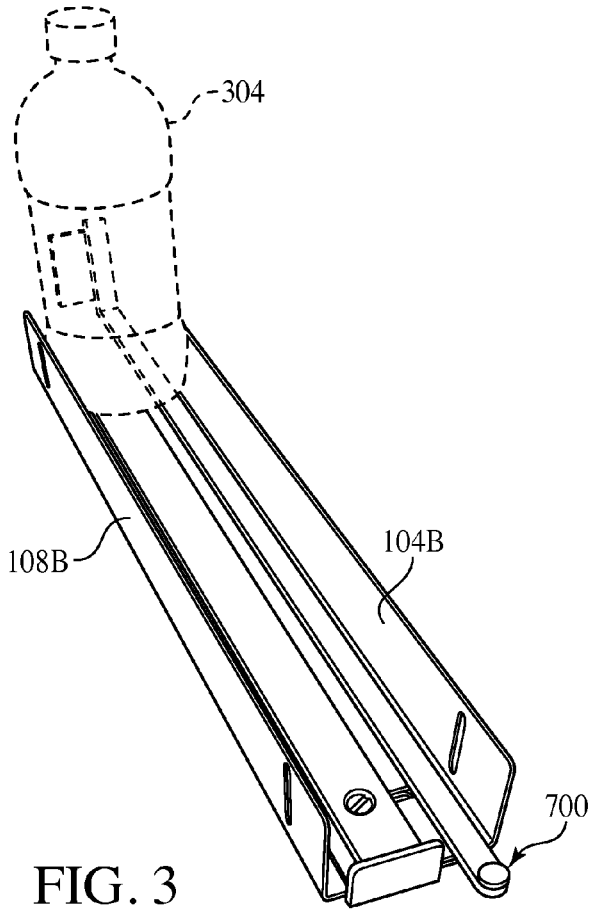
FIG. 3 is a view of an assembled view of an embodiment of the present invention configured to hold a wide item.

As noted above, holes 140R, 140F in the central rail shown in FIG. 1 are adapted to accept bolts 144R, 144F. The bolts preferably pass through the central rail 128, through the pairs of slots in the horizontal portion of the side wall components 104,108 and extend to the bottom of the integrated shelving unit 100 as shown in FIG. 3. The tip of the bolt is preferably flat and is able to accept a nut-like component 148R, 148F, that acts as a receiving base for the bolt 144R, 144F. In the embodiments shown in the attached figures, the nut-like component 148R, 148F may be rectangularly shaped, though a wide variety of shapes may be used. Additionally, the nut-like component 148R, 148F may be implemented as a self-tapping screw that taps into a receiving base. The receiving base may be rectangular in shape, as shown in FIG. 1, or any other shape as desired by the user of the present invention. Mechanisms besides a bolt/nut combination may be used, such as a tension fasteners and any other component that allows the mechanism to set and relieve tension. The central rail component 128 may be used with side wall components 104, 108 having a variety of dimensions, so long as the holes 140R, 140F in the central rail 128 correspond to the slots in the side wall components.

Figure 2:
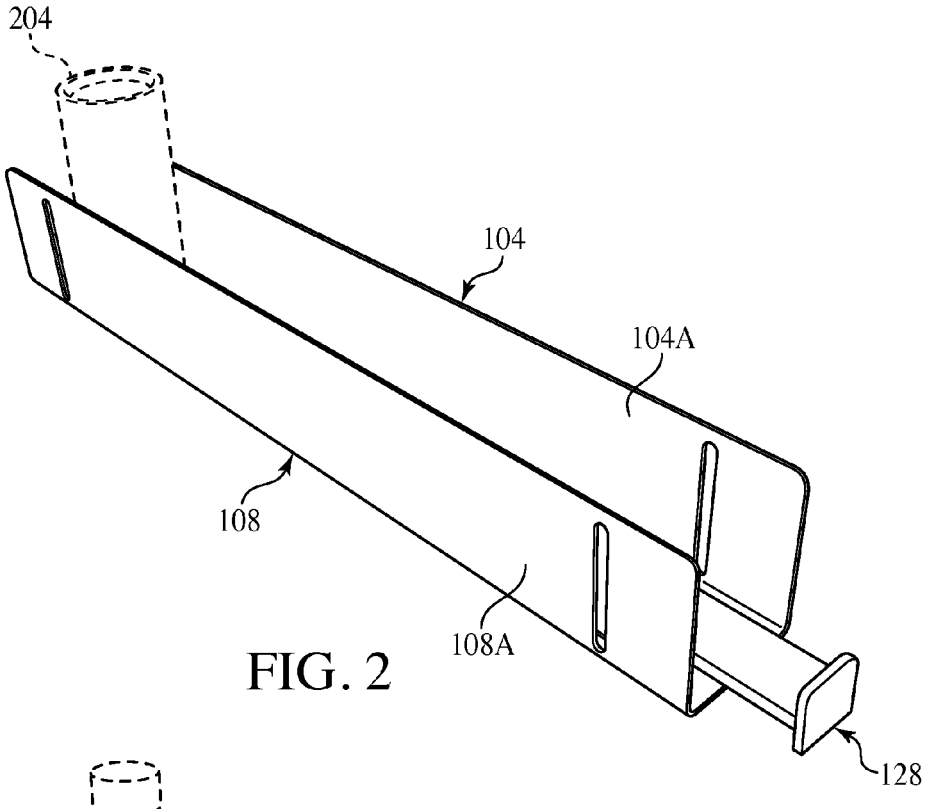
FIG. 2 is a view of an assembled view of an embodiment of the present invention configured to hold a narrow item.
Figure 4:
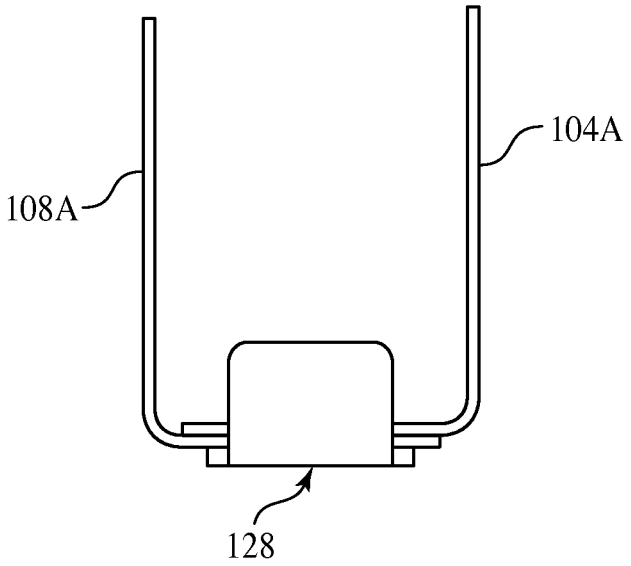
FIG. 4 is an end view of an embodiment of the present invention configured to hold a narrow item.

The adjustable and integrated shelving unit may operate in the following way. The width of the shelving unit is manually set to the appropriate distance as dictated by the product to be housed in the shelving unit. That may, for example, be accomplished by placing the product in the shelving unit 100 and adjusting the width by loosening the bolt/nut combinations (e.g., 144R, 148R & 144F, 148F). During adjustment of the shelving unit's width the bolt-nut combination (e.g., 144R, 148R & 144F, 148F) is loose enough to allow the side components 104, 108 to slide orthogonally to accommodate the product. Once the appropriate width is set, the bolt-nut combination (e.g., 144R, 148R & 144F, 148F) may be tightened to firmly set the width of the shelving unit. In the configuration shown in FIG. 2 for a narrow product 204, the long arms of the L-shaped side wall components 104A, 108A are vertical. This may be easily observed in the end view shown in FIG. 4.

Figure 5:
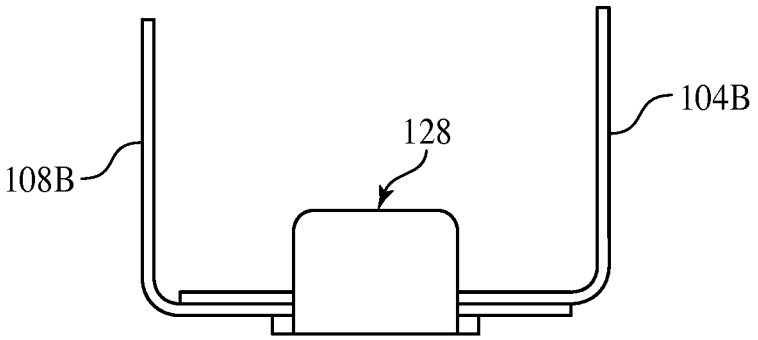
FIG. 5 is an end view of an embodiment of the present invention configured to hold a wide item.

For products having a larger width 304, the shelving unit may be disassembled and the longer arms of the L-shaped side wall components rotated so that they are oriented horizontally to form a portion of the base of the shelving unit, as shown in FIG. 3. FIG. 3 also displays a puller-backstop assembly 700 that may be used in the context of the present invention, as described more fully below. In this configuration, the short arms of the L-shaped side wall components 104B, 108B are vertical. This may be easily observed in the end view shown in FIG. 5. The longer arms of the side wall components 104A, 108A thus allow the shelving unit to accommodate products having a larger width 304. With the shorter arms of the L-shaped side wall components 104B, 108B oriented vertically, the bolt-nut assembly may be adjusted through the process described above. In this manner, the present invention provides a stable shelving unit that is easily adjustable across a wide range of product widths.

Figure 6:
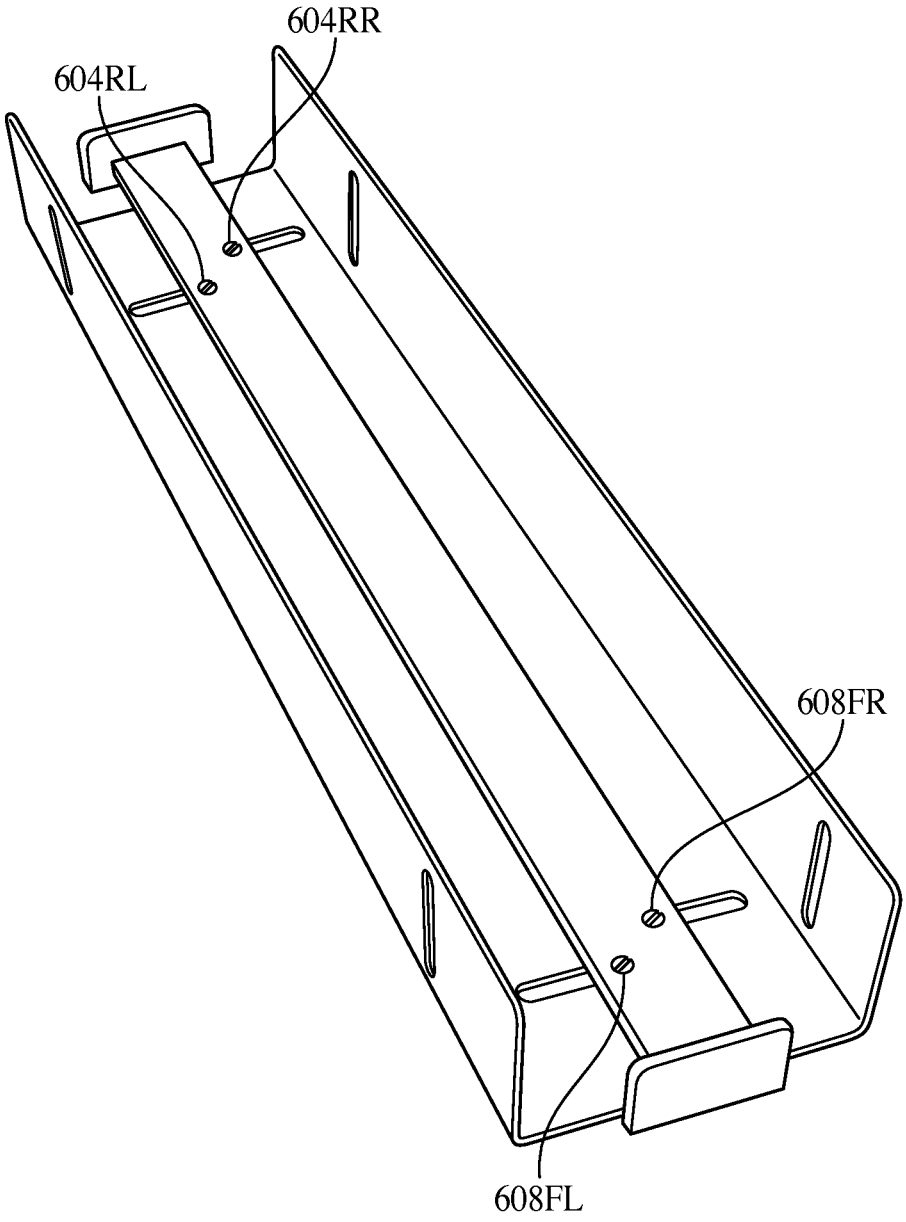
FIG. 6 is a view of an assembled shelving unit of an embodiment of the present invention.

FIG. 6 displays another assembled embodiment of the shelving unit. Unlike the embodiment shown in FIG. 1, this embodiment includes pairs of staggered holes 604RL, 604RR and 608FL, 608FR in the central rail. The holes are staggered in that each hole is located at a different distance from the front of the shelving unit. Each of the holes is designed to accept a bolt, as described above. One pair of staggered holes 604RL, 604RR is located in the rear of the central rail, while a second pair of staggered holes 608FL, 608FR is located towards the front of the central rail. The holes on the left side 604RL, 608FL of the central rail engage only the slot of the left side wall component through a bolt, while the holes on the right side 604RR, 608FR of the central rail engage only the slot of the right side wall component through a bolt. This may be contrasted to the embodiment shown in FIG. 1 where the same bolt engages both the left and right side wall components. By having the bolts-nut combinations (through the holes in the central rail) selectively engage the side wall component on their respective sides of the shelving unit, these embodiments of the shelving units of the present invention may accommodate a wider diversity of product widths.

Figure 7:
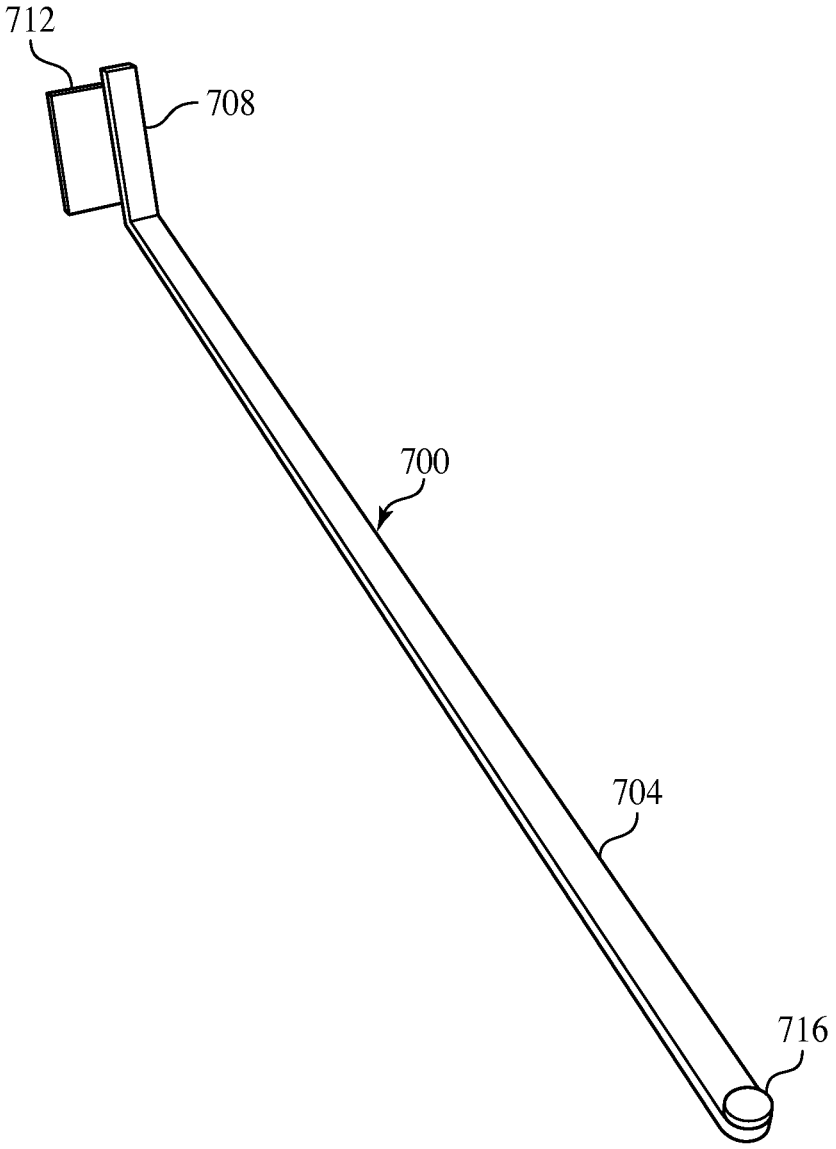
FIG. 7 is a view of a puller member useful within the context of the present invention.

Product may be drawn towards the front of the shelving unit by using numerous mechanisms well known in the art. FIG. 7 displays a backstop-puller assembly 700. The backstop-puller assembly long horizontal arm 704 that extends for the majority of the length of the shelving unit between the left and right side wall components. At the rear of the shelving unit, the long horizontal arm 704 may turn 90 degrees to terminate in an L-shaped vertical arm 708. The vertical arm 708 may be attached to a horizontal member 712 that engages the product and allows it to be drawn towards the front of the shelving unit (as shown in FIG. 3). The front of the backstop-puller assembly may include a grip 716 for easy manipulation by the consumer. In other embodiments, the product may be drawn towards the front of the shelving unit by a bias mechanism (e.g., spring-driven or gravity-driven) whereby product is pushed towards the front of the shelving unit by the bias mechanism In other embodiments, a disengaging puller-backstop mechanism may be used, such as the one shown in U.S. Pat. No. 8,235,226, which is hereby incorporated by reference. In other embodiments, the product may be passively moved by raising the rear of the shelving unit, by hand, or by any other mechanism or strategy well known in the art.

A further advantage of the shelving allocation units of the present invention includes the ability of store personnel to restock shelves with product from the front of the shelf. The shelving allocation units of the present invention may be removed from the shelf and new product may be placed at the rear of the shelving unit behind the existing product. Alternatively, the shelving unit may be stocked with new product from the front of the shelving unit and the entire shelving unit may then be rotated 180 degrees to place older product towards the front of the shelf.

Multiple individual assemblies of the present invention may be used in tandem to provide arrays of shelving space. For example, two shelving units of the present invention may be housed next to one another to accommodate varying sizes of product. Because the shelving units of the present invention may be adjusted to a wide variety of widths, shelving units having the same dimensions may be advantageously used to accommodate a diversity of product sizes without requiring a similar diversity in distinct shelving units - each having unique dimensions.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are disclosed only to facilitate comprehension of the invention and should not be construed to limit the scope thereof.

What is claimed is:

1. A shelving unit, comprising:

a left side wall component in an L-shape having a long arm and a short arm, where the left side wall component further includes two pairs of left side wall slots oriented orthogonally to a longitudinal axis of the left side wall component;

a first pair of the two pairs of the left side wall slots located at a first distance from a front of the left side wall component comprising a slot located on the long arm and a slot located on the short arm, a second pair of the two pairs of the left side wall slots located at a second distance from the front of the left side wall component comprising a slot located on the long arm and a slot located on the short arm, a right side wall component in an L-shape having a long arm and a short arm, where the right side wall component further includes two pairs of right side wall slots oriented orthogonally to a longitudinal axis of the right side wall component, further where the short arm of the left side wall component and the short arm of the right side wall component overlap when both the short arms are in a horizontal orientation;

a first pair of the two pairs of the right side wall slots located at the first distance comprising a slot located on the long arm and a slot located on the short arm, a second pair of the two pairs of the right side wall slots located at the second distance comprising a slot located on the long arm and a slot located on the short arm, where side walls of the shelving unit are defined by either the long arm of the right side wall component and the long arm of the left side wall component or the short arm of the right side wall component and the short arm of the left side wall component;

a central rail comprising a horizontal member, where the horizontal member includes two holes, with a first hole of the two holes located at the first distance and a second hole of the two holes located at the second distance, where each of the two holes is adapted to accept a bolt-nut assembly; and the bolt-nut assembly.

2. The shelving unit of claim 1, further including a backstop-puller assembly.

3. The shelving unit of claim 2, where the backstop-puller assembly rests loosely between the left and right side wall components.

4. The shelving unit of claim 3, where the backstop-puller assembly includes a horizontal arm that resides between the left and right side wall components, where the horizontal arm extends for the majority of a length of the shelving unit and terminates in an L-shaped vertical arm that is attached to a horizontal member located at a rear of the backstop-puller assembly adapted to engage a product located within the shelving unit.

5. The shelving unit of claim 4, where a front end of the horizontal arm includes a grip.

6. The shelving unit of claim 1, wherein a distance between the side walls of the shelving unit is adjustable by loosening the bolt-nut assemblies.

7. The shelving unit of claim 1, where the long arm of the left side wall component and the long arm of the right side wall component overlap when both the long arms are in the horizontal orientation.

8. The shelving unit of claim 1, where the central rail also includes two vertically oriented barrier elements, the first barrier element being located at a front end of the horizontal member and a second barrier element located at a rear end of the horizontal member.

9. A shelving unit, comprising:

a left side wall component in an L-shape having a long arm and a short arm, where the left side wall component further includes two pairs of slots oriented orthogonally to a longitudinal axis of the left side wall component;

a first pair of the two pairs of the left side wall slots located towards a front of the shelving unit comprising a first slot located on the long arm and a second slot located on the short arm, a second pair of the two pairs of the left side wall slots located towards a rear of the shelving unit comprising a slot located on the long arm and a slot located on the short arm, a right side wall component in an L-shape having a long arm and a short arm, where the right side wall component further includes two pairs of slots oriented orthogonally to a longitudinal axis of the right side wall component;

a first pair of the two pairs of the right side wall slots located towards the front of the shelving unit comprising a slot located on the long arm and a slot located on the short arm, a second pair of the two pairs of the right side wall slots located towards the rear of the shelving unit comprising a slot located on the long arm and a slot located on the short arm, where side walls of the shelving unit are defined by either the long arm of the right side wall component and the long arm of the left side wall component or the short arm of the right side wall component and the short arm of the left side wall component; and a central rail comprising a horizontal member, where the horizontal member includes two pairs of staggered holes, with a first pair of staggered holes located towards the front of the shelving unit and a second pair of holes located towards the rear of the shelving unit, where each of the holes is adapted to accept a bolt-nut assembly, where the location of the first pair of staggered holes corresponds to the location of the location of the first pair of left side wall slots and the first pair of right side wall slots where the location of the second pair of staggered holes corresponds to the location of the location of the second pair of left side wall slots and the second pair of right side wall slots; and the nut-bolt assembly.

10. The shelving unit of claim 9, wherein a distance between the side walls of the shelving unit is adjustable by loosening the bolt-nut assemblies.

11. The shelving unit of claim 9, where the short arm of the left side wall component and the short arm of the right side wall component do not overlap when both short arms are in a horizontal orientation.

12. The shelving unit of claim 9, where the long arm of the left side wall component and the long arm of the right side wall component do not overlap when both long arms are in a horizontal orientation.

13. The shelving unit of claim 9, where the central rail also includes two vertically oriented barrier elements, the first barrier element being located at a front end of the horizontal member and a second barrier element located at a rear end of the horizontal member.

* * * * *